United States Patent [19]

Gilbert

[11] 4,308,923

[45] Jan. 5, 1982

[54] ACCU-PRESS

[76] Inventor: Robert E. Gilbert, 187 Western Ave., Buffalo, Wyo. 82834

[21] Appl. No.: 102,617

[22] Filed: Dec. 11, 1979

[51] Int. Cl.[3] ..... E21C 11/02

[52] U.S. Cl. ..... 173/26; 173/43

[58] Field of Search ..... 173/25, 28, 43, 140, 173/26; 52/115

[56] References Cited

U.S. PATENT DOCUMENTS

| | | | |
|---|---|---|---|
| 1,557,635 | 10/1925 | Ware, Jr. | 173/43 X |
| 2,044,880 | 6/1936 | Greve et al. | 173/43 |
| 2,659,583 | 11/1953 | Dorkins | 173/28 |
| 2,815,049 | 12/1957 | Herscovitch | 173/140 X |
| 2,856,155 | 10/1958 | Putt | 173/28 X |
| 3,322,378 | 5/1967 | Thompson | 173/43 X |
| 3,333,646 | 8/1967 | Hoen et al. | 173/43 X |
| 3,357,502 | 12/1967 | Elliott | 173/43 |
| 3,447,613 | 6/1969 | Lisenby | 173/28 |
| 3,452,829 | 7/1969 | Smith | 173/28 |
| 3,500,938 | 3/1970 | Watson | 173/43 X |

FOREIGN PATENT DOCUMENTS

| | | | |
|---|---|---|---|
| 17922 | 1/1972 | Australia | 173/28 |

*Primary Examiner*—Robert Mackey

*Attorney, Agent, or Firm*—Victor J. Evans & Co.

[57] ABSTRACT

Disclosed herein is a device for orienting a drilling auger disposed on and powered by a vehicle defined by a lower frame member carried by the vehicle, an upper frame member pivoted to the lower frame member for rotation about an axis, and an auger supporting framework pivoted to the upper framework for rotation about a second axis orthogonal to the first axis in which the rotation is controlled by hydraulic cylinders extending between the lower and upper frame members, and between the upper frame member and the auger supporting framework, respectively. The auger itself is driven by a power take-off on the vehicle in a preferred form which in conjunction with the preceeding structure allows the auger to address the earth in which the hole is to be drilled in substantially any angle above the surface of the earth.

7 Claims, 6 Drawing Figures

FIG. 1
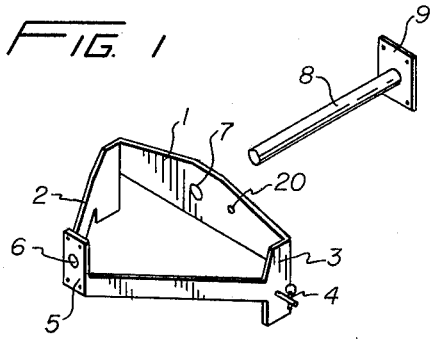
FIG. 2
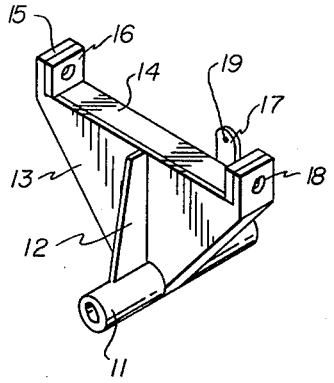
FIG. 3
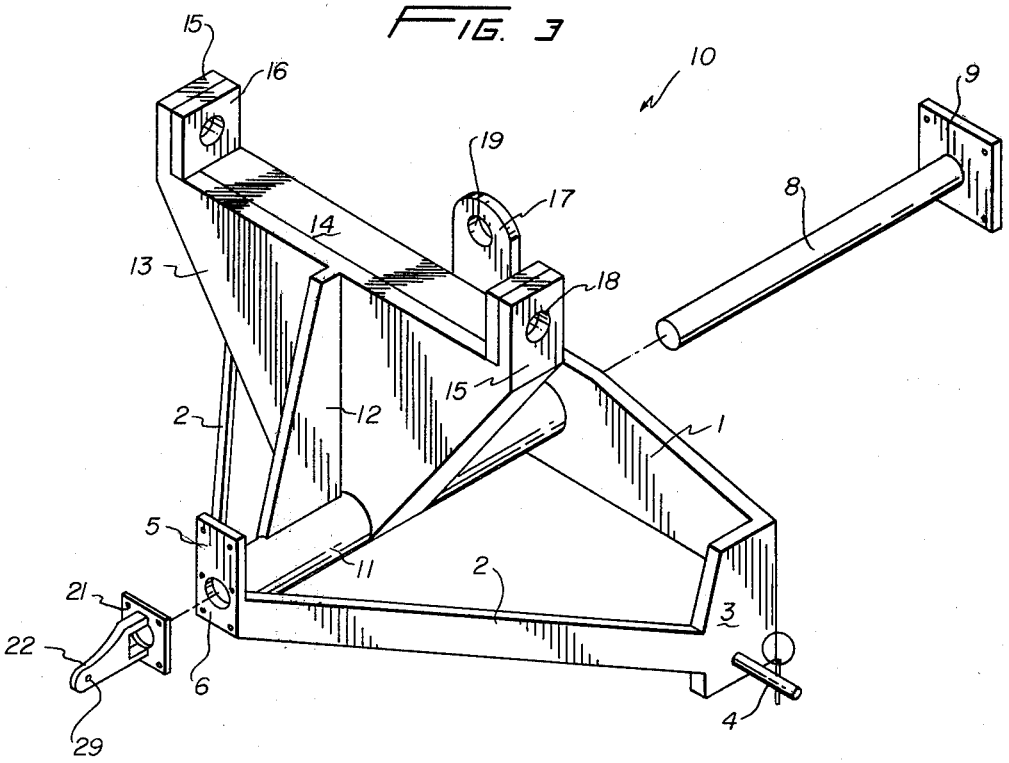
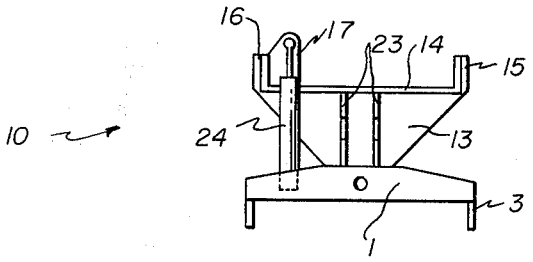
FIG. 6

ACCU-PRESS

BACKGROUND OF THE INVENTION

Earth boring machines have existed for quite some time now, and these machines which are most efficient comprise specially designed mobile trucks provided with outriggers and the like to provide the greatest control in boring at any specified angle.

The following patents reflect the state of the art as far as applicant is aware:

U.S. Pat. No. 1,319,259 Adams
U.S. Pat. No. 1,376,045 Skott
U.S. Pat. No. 2,474,981 McCardell
U.S. Pat. No. 2,602,637 Talbot
U.S. Pat. No. 3,148,739 Mattingly et al
U.S. Pat. No. 3,306,372 Struve
U.S. Pat. No. 3,714,990 Tomik Of these, Mattingly et al teach the use of a boring auger which is capable of angulation relative to a vertical plane, but clearly is not for use with hydraulics of a tractor.

Tomik provides an auger plow using a three-point linkage (10) plus lower arms (11) to provide the necessary support. His structure is essentially more complex than that which defines the instant application, and further this patent is silent on the precise and specific drilling concepts which form the basis of the present invention.

The remaining references, while showing the state of the art further, merely provide isolated elements which may share a coincidental similarity with certain aspects of the instant application, but none of these references either teach or render obvious the apparatus according to the instant application.

SUMMARY OF THE INVENTION

Accordingly, this apparatus has as an object an improvement in hole digging machines which benefits from the widely used three-point hitch system of agricultural tractors so that people currently owning tractors having a three-point hitch system can advantageously benefit from this machine without the need for and expense of a specialized drilling vehicle.

To this end, a lower framework is provided which is used to attach to the conventional hitch systems commonly found in agricultural tractors.

A further object of the invention is to provide a hole boring machine which provides accurate hydraulic directional control of the auger when digging and also to provide hydraulic lift and down pressure control.

It is a further object of this invention to provide auger support arms attached well above the top link point of a tractor. This is a desirable feature since the top portion of the auger by virtue of the construction associated in the instant application can be leaned from side to side without moving the point of the auger from its intended starting position.

It is a further object of the present invention to provide a construction for the top link point in which the support arms are attached to the auger in such a fashion that the angle of attack of the auger can travel through a larger arc and therefor provide angulated boring holes having a greater range than the prior art devices.

It is still a further object of the invention to beneficially utilize the tractor's own shock absorber system to cushion the hydraulic down pressure feed of the auger. If the operator should accidentally apply too much pressure in the drilling operation, the tractor's own shock system absorbs the excess pressure and feeds it out automatically as the resistance decreases in the drilling operation.

It is yet a further object of this invention to provide a device of the character described above which is relatively easy to install upon a tractor, of durable construction, and relatively inexpensive when compared with the traditional mechanisms for boring equipment.

A further object of this invention contemplates providing a device of the character described above which is relatively easy to use, and extremely safe in its construction and use.

These and other objects will be made manifest when considering the following detailed specification when taken in conjunction with the appended drawings.

BRIEF DESCRIPTION OF THE DRAWINGS

FIG. 1 is a perspective view of the lower frame member and the first pivot axis according to the present invention.

FIG. 2 is a perspective view of an upper frame member pivotally connected to the lower frame member about the first pivot axis.

FIG. 3 is a perspective view of the upper and lower frame members aligned so that the first axis and its associated structure can fasten the upper and lower frame members together.

FIG. 6 is a rear view of the upper and lower frame members and hydraulic control mechanism to control the degree of rotation between the first and second frame members.

BRIEF DESCRIPTION OF THE PREFERRED EMBODIMENT

Figure 4:
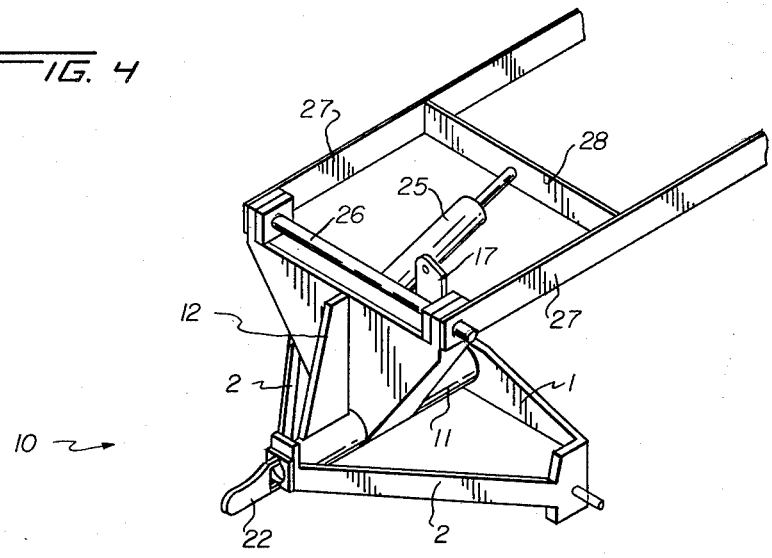
FIG. 4 is a perspective view of the upper and lower frame members, and the auger support framework fastened to the upper frame member about a second axis orthogonal to the first axis and its pivot structure.
Figure 5:
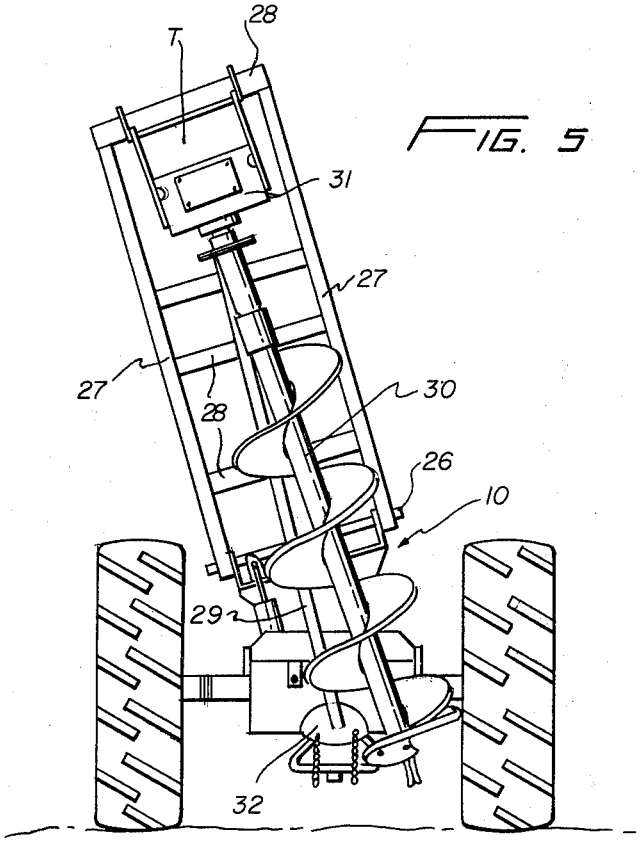
FIG. 5 is a view of the auger and its support structure when assembled on a tractor.

Referring to the drawings now, wherein like reference numerals refer to like parts throughout the various drawing figures, reference numeral 10 is directed to the auger carrying device according to the present invention.

This auger carrying device is defined by a lower framework having a substantially isosceles triangle configuration when viewed from a top plan perspective thereof to which the apices are truncated, as will now be described. Base member 1 has a thickened medial portion and the two equilateral sides 2 are connected to the base member 1 by means of plates 3. The two equilateral sides 2 terminate and meet at a further truncated apex plate 5 having an opening 6 therein which registers with an opening 7 disposed at the thickened medial portion of the base 1. As shown particularly well in FIGS. 1 and 3, the truncated apices 3 meet with the equilateral sides 2 in a tapered area so that the sides 2 do not have the same relative width as the apices 3. Extending outwardly from each apex is an outwardly extending pin 4 and these pins 4 are used to connect with two support arms traditionally found on tractors. Further, a shaft 8 is adapted to register with and extends through holes 6 and 7 and a terminal portion of the shaft 8 comprises a plate 9 which bolts to an outside face of the base member 1 and as shown in FIG. 4; the shaft 8 extends somewhat beyond the hole 6 of the lower frame member. The truncated apex 5 of the triangle has a flattened surface upon which bolts a snout 22 having a complementally formed plate 21 for fastening therewith. The snout 22 has a generally tapered configuration extending along the axis defined by the shaft 8 and means defining an opening 29 is provided on the snout 22 for co-action with the third connection area on a tractor.

A second frame member 13 also of substantially isosceles triangle configuration is connected to the first or lower frame member by means of a cylindrical sleeve 11 disposed at an apex of the equilateral sides of this second triangle and the cylindrical sleeve 11 overlies the shaft 8 as shown in FIG. 3. Consequently, rotation about shaft 8 is possible, and in order to control the degree of rotation, an upstanding ear 17 extending from the base 14 of the isosceles triangle 13 is provided with a hole 19 which when taken with hole 20 on base 1 of the lower frame member can serve to support a hydraulic cylinder 24 (FIG. 6) which can conveniently be energized by means of a hydraulic power take-off common on most tractors. Terminal portions of base 14 are provided with upstanding tabs 15 that extend beyond the height of the base and a reinforcing spacer 16 is provided on inside portions of the tabs 15 as shown in FIG. 3 so that the tabs 15 and reinforcing spacers 16 in conjunction with the base 14 form a substantially open-sided rectangle. The holes 18 disposed therewithin serve as a nesting area for shaft 26 which forms a second axis of rotation perpendicular to the first shaft 8 so that motion about the shaft 26 can occur when the auger support framework is to pivot about that second axis.

The auger support network is defined by a pair of spaced parallel rod members 27 inter-braced by crossbars 28 and a terminal portion of the auger support framework is provided with a transmission T which drives the auger 30 by means of a drive shaft 29 operatively connected to a second power take-off on the tractor 32.

The angulation between the auger support frame 27, 28 and the upper frame member 13 includes a pair of spaced webs 23 (FIG. 6) which support one end of a second hydraulic cylinder 25, the terminal portion of this hydraulic cylinder being connected to crossbar 28 as shown in FIG. 4. Similar to the first hydraulic unit 24, this hydraulic unit 25 is actuated and energized by a hydraulic power take-off on the tractor. On the face of the upper frame member 13 opposed from the pair of spaced parallel hydraulic support webs 23, a further web 12 is provided for additional structural rigidity. As shown in FIG. 3, web 12 extends from the base 14 of the upper frame member downwardly to the cylinder 11 to rigidify the plate 13.

Having thus described the invention, it should be apparent that there has been provided a support structure for an auger conveniently adapted to fasten on a tractor which can rotate about two axes one orthogonal to the other. Further, it should be apparent that numerous structural modifications are contemplated as being a part of this invention as set forth hereinabove and as defined hereinbelow by the claims.

What I claim is:

1. A device including a drilling auger removably attachable to and powered by a tractor type vehicle having power takeoffs comprising in combination:

a lower frame member carried by the vehicle, an upper frame member pivoted to said lower frame member having first means for controlled rotation about a first axis, and a supporting framework carrying the auger and pivoted to said upper framework having second means for controlled rotation about a second axis orthogonal to said first axis whereby the auger is suitably supported and able to bore into earth at substantially any angle relative to a plane defined by the earth wherein said lower frame member forms substantially an isosceles triangle when viewed in a top plan view having truncated apices and said first axis extends from a midportion of a base of said lower frame member to an apex where two equal-length sides meet in which said truncated apices have outer faces which attach to the vehicle including: projecting pins on two apices proximate to said base and a plate bolted onto the remaining apex, said plate having a tongue-shaped snout for connection with said vehicle, said lower frame member disposed in a horizontal plane

2. The device of claim 1 wherein said upper frame member forms a second isosceles triangle connected to said first axis at an apex where two equilateral sides meet, and said second axis parallels a base of said second isosceles triangle.

3. The device of claim 2 wherein said first means for controlled rotation about said first axis includes a first expansible cylinder means extending between said upper and lower frame members, and said second means for controlled rotation about said second axis includes a second expansible cylinder means extending between said upper frame member and said auger supporting framework.

4. The device of claim 3 wherein said first axis includes holes in said apex and base of said lower frame member, a sleeve on said upper frame member extending between said holes, a shaft extending through said holes and sleeve and a locking plate affixing said shaft to an outer face of said base of said lower frame member.

5. The device of claim 4 wherein said second axis includes tabs extending up from said base of said upper frame member having holes therethrough said supporting framework carrying the auger including spaced parallel rod members with terminal portions having holes in registry with said tab holes, and a second shaft extending through said holes, retaining said upper frame member and said supporting framework carrying the auger.

6. The device of claim 5 wherein said expansible cylinders are hydraulically driven by the vehicle and said auger depends from said auger support framework at an extremity remote from said second axis, said auger operatively connected to said vehicle through a propeller shaft extending from the vehicle through a transmission.

7. The device of claim 6 including a front web on said upper frame member extending between said sleeve and triangle, a pair of spaced parallel webs on a back face of said triangle having support holes therethrough for fastening said second expansible cylinder thereto.

* * * * *